US008172098B2

(12) United States Patent
Eustace et al.

(10) Patent No.: US 8,172,098 B2
(45) Date of Patent: May 8, 2012

(54) MODULAR RACK ASSEMBLY

(75) Inventors: Brian Eustace, Sierra Madre, CA (US); Dan David, La Canada-Flintridge, CA (US)

(73) Assignee: Rapid Rack Industries, Inc., City of Industry, CA (US)

( * ) Notice: Subject to any disclaimer, the term of this patent is extended or adjusted under 35 U.S.C. 154(b) by 422 days.

(21) Appl. No.: 12/436,771

(22) Filed: May 6, 2009

(65) Prior Publication Data

US 2009/0277854 A1 Nov. 12, 2009

Related U.S. Application Data

(60) Provisional application No. 61/050,992, filed on May 6, 2008.

(51) Int. Cl.
*A47B 45/00* (2006.01)

(52) U.S. Cl. ..... 211/191; 211/189

(58) Field of Classification Search ..... 211/186, 211/188, 189, 191, 192, 194, 195, 70.6; 108/91; 144/285, 286.1, 286.5
See application file for complete search history.

(56) References Cited

U.S. PATENT DOCUMENTS

| | | | | | |
|---|---|---|---|---|---|
| 1,688,533 | A | * | 10/1928 | Eger | 144/285 |
| 2,815,130 | A | * | 12/1957 | Franks | 211/191 |
| 2,918,176 | A | * | 12/1959 | Bell et al. | 211/191 |
| 2,984,363 | A | * | 5/1961 | Lang et al. | 211/182 |
| 3,042,221 | A | * | 7/1962 | Rasmussen | 211/183 |
| 3,048,245 | A | * | 8/1962 | Shewell | 403/190 |
| 3,072,262 | A | * | 1/1963 | Cassel | 211/191 |
| 3,095,975 | A | * | 7/1963 | Cassel et al. | 211/192 |
| 3,142,386 | A | * | 7/1964 | Skubic | 211/191 |
| 3,157,424 | A | * | 11/1964 | Hall | 294/68.3 |
| 3,194,407 | A | * | 7/1965 | D'Altrui | 211/191 |
| 3,392,848 | A | * | 7/1968 | McConnell et al. | 211/192 |
| 3,434,436 | A | * | 3/1969 | Solo | 108/128 |
| 3,465,898 | A | * | 9/1969 | Klein | 211/194 |
| 4,450,775 | A | * | 5/1984 | Brendle | 108/64 |
| 5,012,938 | A | * | 5/1991 | King | 211/191 |
| 5,553,551 | A | * | 9/1996 | Crombie | 108/181 |
| 5,918,750 | A | * | 7/1999 | Jackson | 211/189 |
| 6,729,371 | B2 | * | 5/2004 | Sheahan et al. | 144/286.1 |
| 6,739,463 | B2 | * | 5/2004 | Wishart et al. | 211/189 |
| 6,786,162 | B1 | * | 9/2004 | Volkmer et al. | 108/115 |
| 6,978,906 | B2 | * | 12/2005 | Wishart et al. | 211/189 |
| 7,350,549 | B2 | * | 4/2008 | Carter | 144/285 |
| 7,540,312 | B2 | * | 6/2009 | Carter | 144/286.5 |
| 7,565,922 | B2 | * | 7/2009 | Carter | 144/286.1 |
| 7,712,493 | B2 | * | 5/2010 | Carter | 144/286.1 |
| 2003/0094124 | A1 | * | 5/2003 | Wishart et al. | 108/51.11 |
| 2003/0155319 | A1 | * | 8/2003 | Wishart et al. | 211/189 |
| 2005/0016943 | A1 | * | 1/2005 | Dick | 211/70.6 |
| 2007/0119808 | A1 | * | 5/2007 | Wishart et al. | 211/189 |
| 2007/0193190 | A1 | * | 8/2007 | Konstant | 52/693 |
| 2008/0272676 | A1 | * | 11/2008 | Eustace et al. | 312/243 |

* cited by examiner

*Primary Examiner* — Darnell Jayne
*Assistant Examiner* — Patrick Hawn
(74) *Attorney, Agent, or Firm* — Christie, Parker & Hale, LLP

(57) ABSTRACT

An end support unit for supporting the ends of at least one front and one rear cross beam including: a front support post having a column of slots along its length for receiving at least one slot engaging member of the front cross beam; a rear support post having a column of slots along its length for receiving at least one slot engaging member of the rear cross beam; an upper brace fixedly extending from the upper end of the front support post to the upper end of the rear support post; a lower brace fixedly extending from the lower end of the front support post to the lower end of the rear support post; and a diagonal brace extending diagonally between the front support post and the rear support post.

3 Claims, 11 Drawing Sheets

Fig. 1
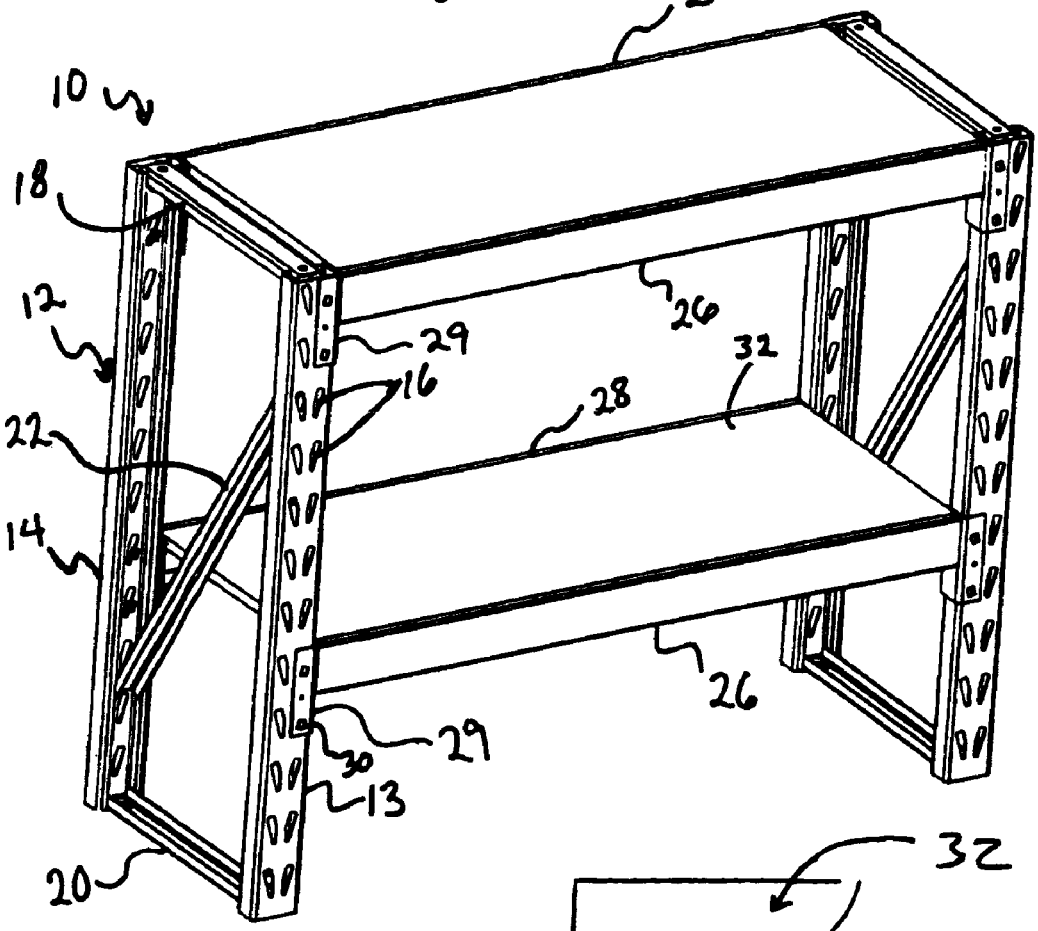
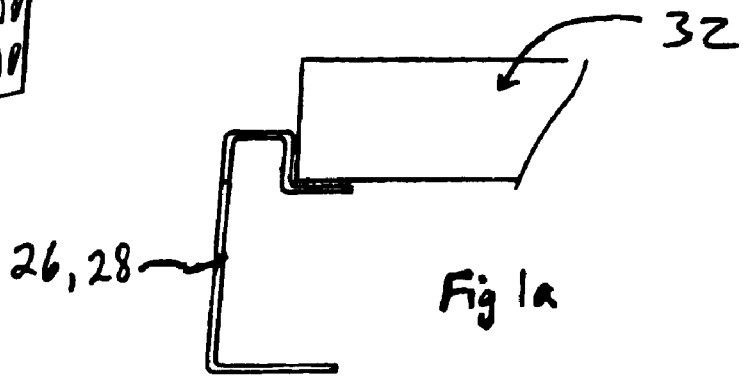
Fig 1a

MODULAR RACK ASSEMBLY

CROSS-REFERENCE TO RELATED PATENT APPLICATION

This application claims priority to and the benefit of U.S. Patent Application Ser. No. 61/050,992, filed on May 6, 2008, in the United States Patent and Trademark Office, the entire content of which is incorporated herein by reference.

BACKGROUND OF THE INVENTION

The present invention relates to a modular rack assembly. While there are a variety of modular rack assemblies that have been designed to store various items, they are not easily configurable for shipping. Further, conventional modular racks are not formed of a simple construction and may be expensive to manufacture and difficult to assemble and adjust.

SUMMARY OF THE INVENTION

An embodiment of the present invention provides an end support unit for supporting the ends of at least one front and one rear cross beam including: a generally vertical front support post having at least one column of slots along its length for receiving at least one slot engaging member of the front cross beam; a generally vertical rear support post having at least one column of slots along its length for receiving at least one slot engaging member of the rear cross beam; a generally horizontal upper brace fixedly attached to and extending from the upper end of the front support post to the upper end of the rear support post; a generally horizontal lower brace fixedly attached to and extending from the lower end of the front support post to the lower end of the rear support post; and at least one diagonal brace fixedly attached to and extending diagonally between the front support post and the rear support post.

The upper brace may have at least one hole for receiving the shaft of a connector for securely mounting a secondary component to the end support unit.

The lower brace may have at least one hole for receiving the shaft of an anchor for securely anchoring the end support unit to a floor location or a connector for securely mounting a secondary component to the end support unit.

The slots may be key-hole shaped. The slot engaging members may be rivets. The slots may be wedge-shaped. The slot engaging members may be lances.

The end support units may be about 3, inches wide, about 17, inches deep, and about 36 inches high.

The support posts may be c-shaped. The braces may be c-shaped.

Another embodiment of the present invention provides an end support unit assembly including an upper end support unit stacked on top of a lower end support unit for supporting the ends of at least one front and one rear cross beam. Each end support unit includes: a generally vertical front support post having at least one column of slots along its length for receiving at least one slot engaging member of the front cross beam; a generally vertical rear support post having at least one column of slots along its length for receiving at least one slot engaging member of the rear cross beam; a generally horizontal upper brace fixedly attached to and extending from the upper end of the front support post to the upper end of the rear support post; a generally horizontal lower brace fixedly attached to and extending from the lower end of the front support post to the lower end of the rear support post; at least one diagonal brace fixedly attached to and extending diagonally between the front support post and the rear support post; and a pair of connectors extending through holes in the lower brace of the upper end support unit and the upper brace of the lower end support unit to secure the upper end support unit to the lower end support unit.

Each connector may include a bolt, a lock washer, and a nut.

Another embodiment of the present invention provides a storage rack including: at least one left end support unit and at least one right end support unit for supporting the ends of at least one front and one rear cross beam. Each end support unit includes: a generally vertical front support post having at least one column of slots along its length for receiving at least one slot engaging member of the front cross beam; a generally vertical rear support post having at least one column of slots along its length for receiving at least one slot engaging member of the rear cross beams; a generally horizontal upper brace fixedly attached to and extending from the upper end of the front support post to the upper end of the rear support post; a generally horizontal lower brace fixedly attached to and extending from the lower end of the front support post to the lower end of the rear support post; and at least one diagonal brace fixedly attached to and extending diagonally between the front support post and the rear support post; at least one front cross beam, wherein the at least one front cross beam is mounted on and extending between the left and right front support posts of the left and right end support units; at least one rear cross beam, wherein the at least one rear cross beam is mounted on and extending between the rear support posts of the right and left end support units at about the same elevation as the front cross beam; and at least one shelf panel, wherein the at least one shelf panel is supported at its front and rear edges by at least one front and rear cross beam.

The storage rack may include four pairs of front and rear cross beams, four shelves, and four end support units, and wherein the disassembled storage rack is packaged in a space that is about 39, inches by about 17, inches by about 16, inches.

The front and rear cross beams may include at each end an L-shaped flange with a pair of slot engaging members extending inwardly from the flange to engage the slots.

The front and rear cross beams may include a ledge for receiving the shelf panel.

Another embodiment of the present invention provides a work bench assembly including: right and left end support units for supporting the ends of at least one front and one rear cross beam. Each end support unit includes: a generally vertical front support post having at least one column of slots along its length for receiving at least one slot engaging member of the front cross beam; a generally vertical rear support post having at least one column of slots along its length for receiving at least one slot engaging member of the rear cross beam; a generally horizontal upper brace fixedly attached to and extending from the upper end of the front support post to the upper end of the rear support post; a generally horizontal lower brace fixedly attached to and extending from the lower end of the front support post to the lower end of the rear support post; at least one diagonal brace fixedly attached to and extending diagonally between the front support post and the rear support post; an upper front cross beam extending between the upper ends of the front support posts of the right and left end support units; an upper rear cross beam extending between the upper ends of the rear support posts of the right and left end support units; a lower rear cross beam extending between a lower portion of the rear support posts of the right and left end support units; a top panel having front and rear edge portions supported at its front and rear edge portions by the upper front cross beam and upper rear cross beam; right and left upright supports mounted to and extending upwardly from a rear portion of the right and left end support units; a cross beam mounted to and extending between the upper ends of the right and left upright supports; and a generally vertical panel extending between at least a portion of the right and left upright supports and below the cross-beam that extends between the upper ends of the upright supports.

The generally vertical panel may include pegboard.

The generally vertical panel may include upper and lower pegboard panels connected by an elongated strip connector having a generally H-shaped cross-sectional configuration that forms a pair of grooves for receiving the lower end of the upper pegboard panel and the upper edge of the lower pegboard panel.

The workbench assembly may further include a cover mounted over the upper braces.

BRIEF DESCRIPTION OF THE DRAWINGS

The accompanying drawings, together with the specification, illustrate exemplary embodiments of the present invention, and, together with the description, serve to explain the principles of the present invention.

FIG. 1 is a front perspective view of a storage rack according to an embodiment of the present invention.

FIG. 1*a*, is a cross-sectional view of a portion of the storage rack of FIG. 1.

DETAILED DESCRIPTION

Figure 2:
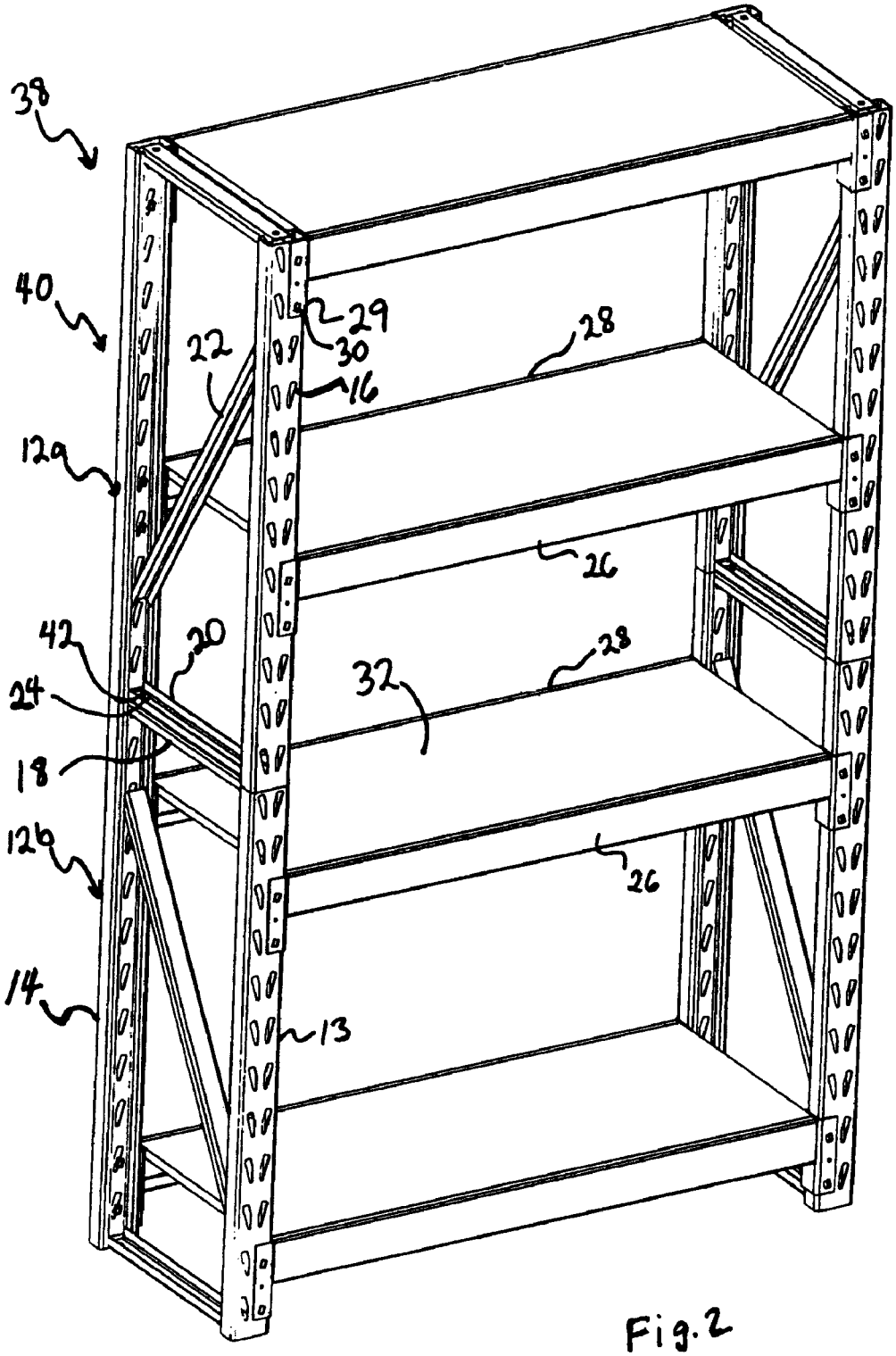
FIG. 2 is a front perspective view of a storage rack according to another embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

With reference to FIG. 1 there is shown a boltless storage rack assembly 10 according to an embodiment of the present invention. The rack assembly 10 comprises right and left end support units 12, each end support unit 12 comprising a front support post 13, a rear support post 14, an upper brace 18, a lower brace 20, and a diagonal brace 22. The upper, lower and diagonal braces 18, 20, 22 are fixedly attached at their ends, preferably by welding, to the front and rear support posts 13 and 14. The front and rear support posts 13 and 14 include at least one column of aligned slots 16 for receiving slot engaging members of cross beams 26, 28. The front and rear support posts 13 and 14 of the end support units 12 may include right and left columns of slots 16. Front cross beams 26 are boltlessly mounted at their ends to the front posts 13 of right and left end support units 12. Rear cross beams 28 are likewise boltlessly mounted at their ends to the rear support posts 14 of the right and left end support units 12 at the same elevations as the front cross beams 26.

It is understood that the cross-sectional configuration of the support posts and braces may vary as desired. In the embodiment shown in FIG. 1, the cross-sectional configuration of the posts and braces are generally C-shaped.

Likewise the cross-sectional configuration of the cross beams may vary as desired. In the embodiment of FIG. 1, the cross beams 26, 28 have cross-sectional configurations as shown in FIG. 1*a*. Here, the cross beams have a ledge for receiving a shelf panel 32. The cross beams 26 and 28 have an L-shaped flange 29 at each end. A pair of slot engaging members (in this case lances) 30 extend inwardly from the flange 29 to engage wedge-shaped slots 16 in the support posts 13 and 14.

The slots 16 and slot engaging members 30 may also vary as desired. For example, in another exemplary embodiment, the slots have a key-hole shape and the slot engaging members are rivets that extend inwardly from the ends of the cross beams.

The dimensions of the end support units 12 and cross beams 26 and 28 may also vary. In one embodiment, the end support units 12 are about 3, inches high and about 17, inches deep. In one embodiment, the length of the cross beams is about 39, inches so that the overall width of the rack is about 41, inches.

Figure 3:
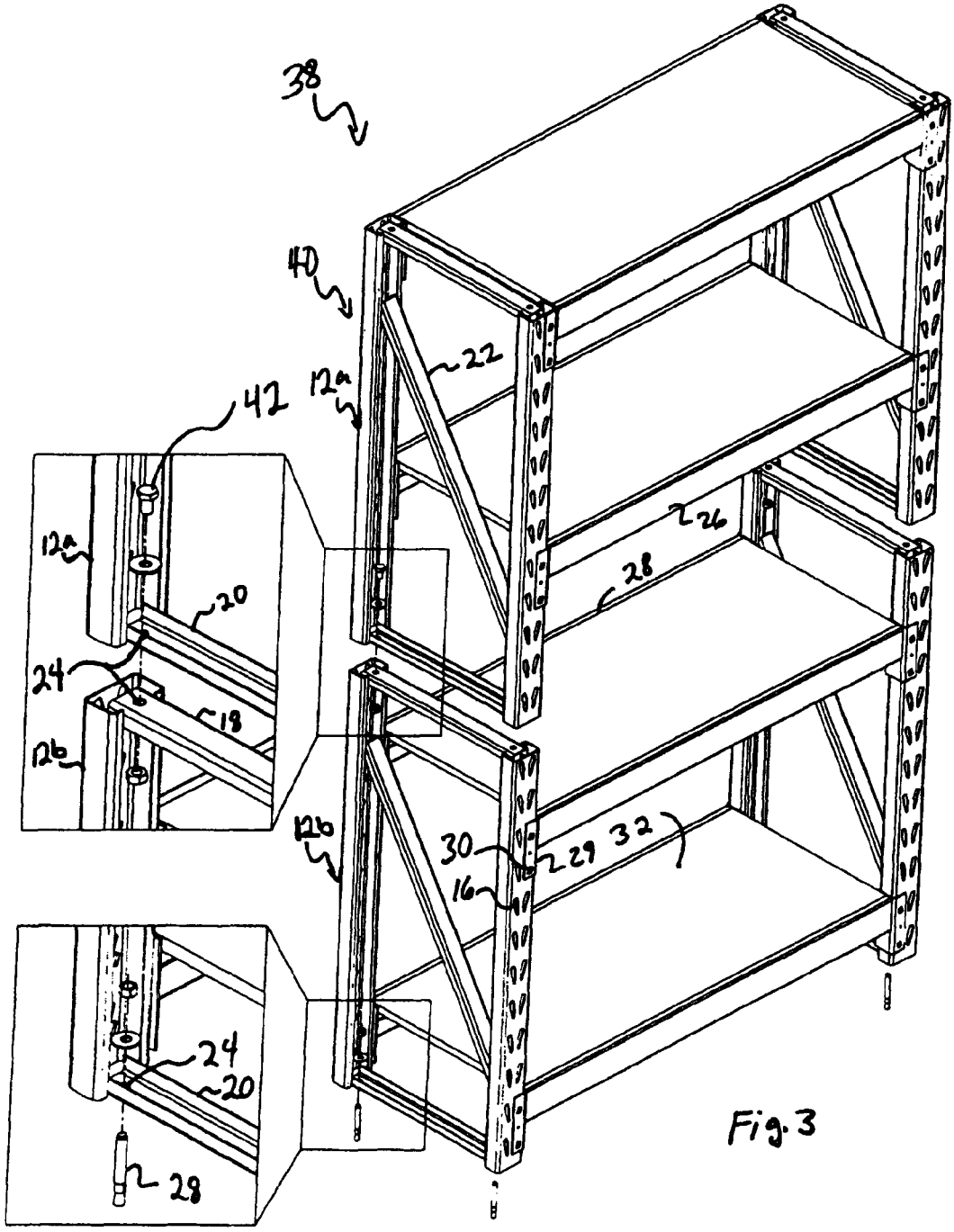
FIG. 3 is an exploded view of the storage rack shown in FIG. 2.

With reference to FIGS. 2 and 3, there is shown a stacked rack assembly 38 according to an embodiment of the present invention. The stacked rack assembly 38 comprises right and left end support assemblies 40, each end support assembly 40 including a pair of end support units 12*a*, 12*b*, stacked one on top of the other. The upper end support unit 12*a*, is securely mounted to the lower end support unit 12*b*, with connectors 42, e.g., bolts which extend through holes 24 in the lower brace 20 of the upper end support unit 12*a*, and aligned holes 24 in the upper brace 18 of the lower end support unit 12*b*. The bolts 42 are secured with appropriate lock washers and nuts. It is to be understood that any suitable connector may be used.

A plurality of front and rear cross beams 26 and 28 are boltlessly mounted to the front and rear support posts 13 and 14 of the end support units 12 that make up the end support assemblies 40. Shelf panels 32 are positioned between and supported at their front and rear edge portions by the front and rear cross beams 26 and 28. As shown, the stacked rack assembly 38 can be anchored at a particular floor location by means of anchors 28 or the like which extend through holes 24 in the lower brace 20 of the lower end support unit 12*b*, and into the floor. The type of anchor will vary depending on the material of the floor. For example, expandable wedge anchors, sleeve anchors, etc., as are well-known in the art may be used with concrete floors, whereas leg bolts or the like may be used for wood floors.

Figure 4:
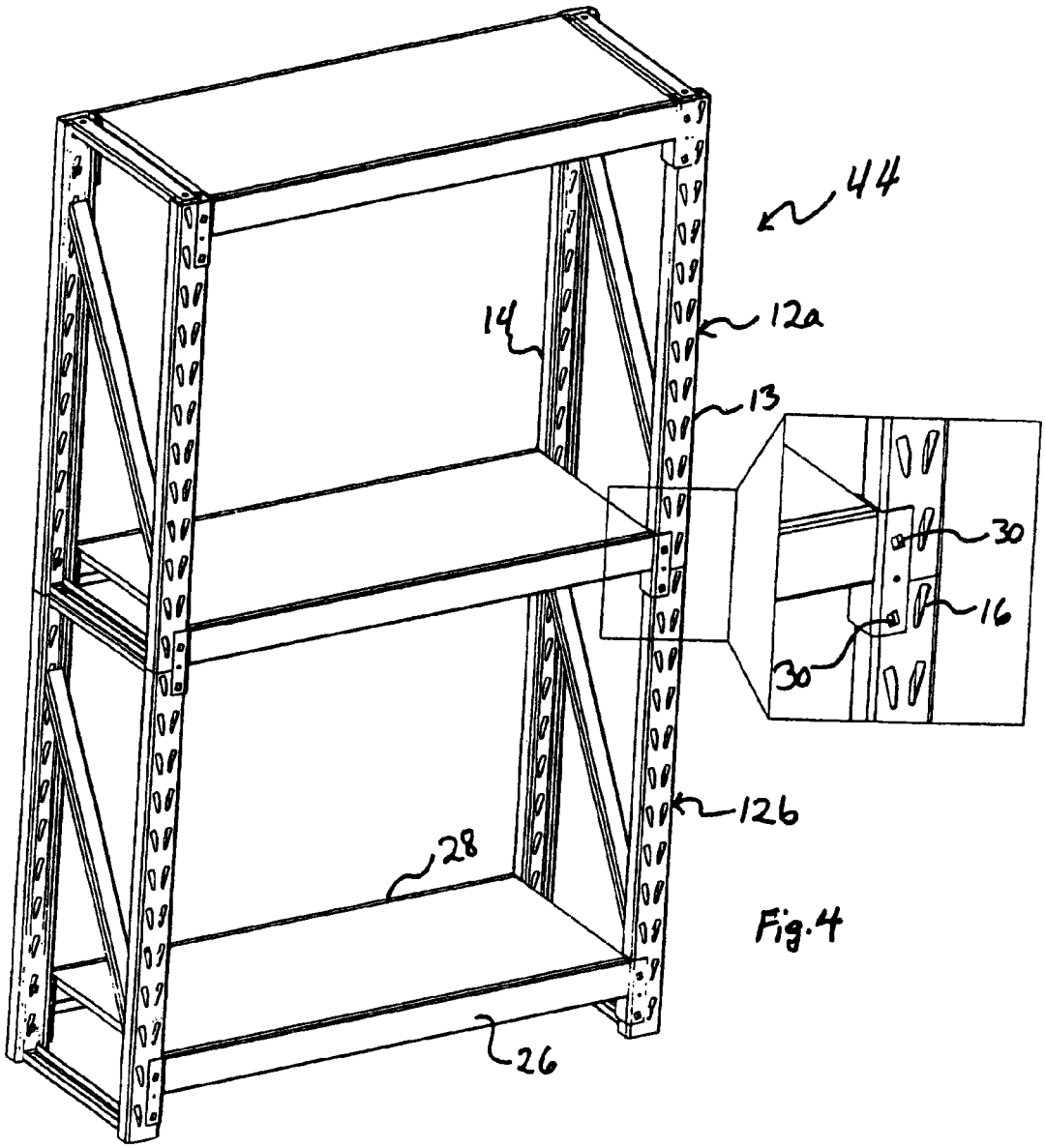
FIG. 4 is a front perspective view of a storage rack according to another embodiment of the present invention.

Another modular rack assembly 44 according to an embodiment of the present invention is shown in FIG. 4. As shown in this embodiment, the upper and lower end support units 12*a*, and 12*b*, may be secured together by means of front and rear cross beams 26 and 28 wherein the upper slot engaging members 30 at each end of the cross beams engage the lowest slot 16 in the front and rear posts 13 and 14 of the upper end support unit 12*a*, and the lower slot-engaging members 30 of the cross beams engage the uppermost slot 16 of the front and rear post 13 and 14 of the lower end support unit 12*b*. In this way, seating of the slot-engaging members 30 into the slots 16 secures the upper and lower end-support units 12*a*, and 12*b*, together. Optionally, the upper and lower end support units 12*a*, and 12*b*, may be further secured together by bolts 42 or the like, as described with respect to FIGS. 2 and 3.

Figure 6:
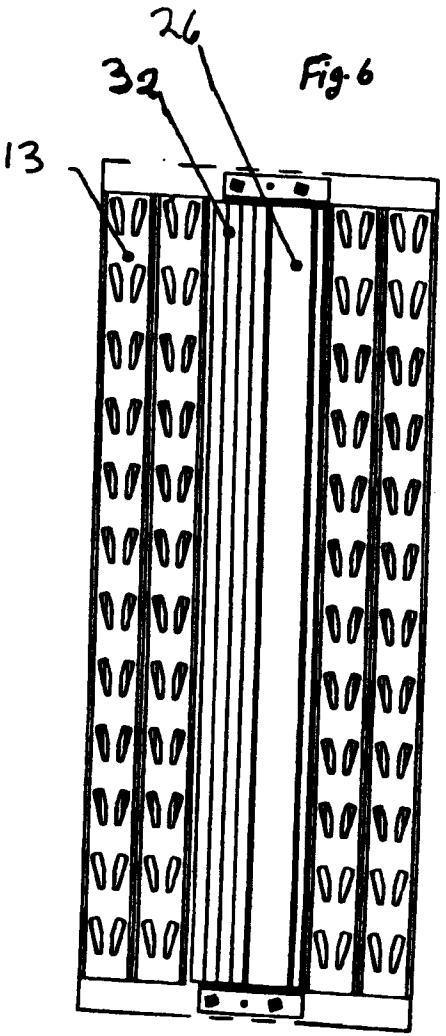
FIG. 6 is an end-view of the exemplary storage racks shown in FIGS. 2-4 assembled for shipping.
Figure 5:
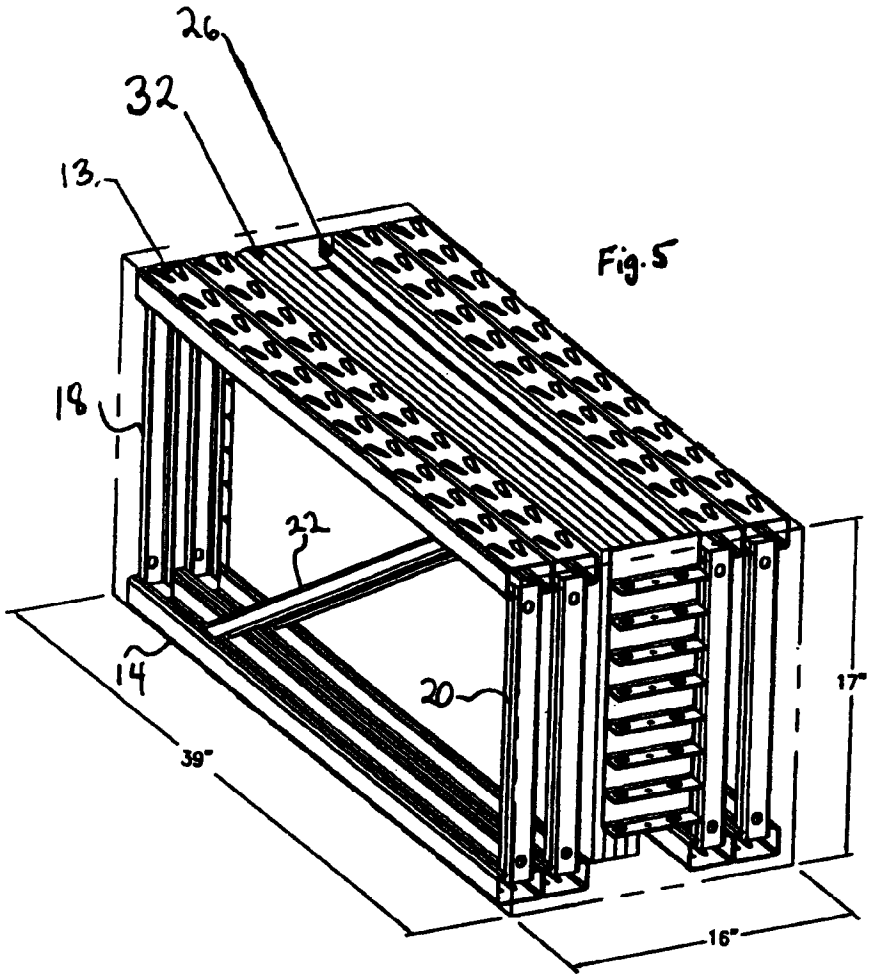
FIG. 5 is perspective view of the components of the storage rack shown in FIGS. 2-4 arranged for shipping.

One of the benefits of the present invention is that a 72-inch high by 17, inch deep by 41 inch wide rack assembly having four pairs of front and rear cross-beams and four shelves may be packaged in a space having the dimensions 39, inches by 17, inches by less than 16, inches. This allows the rack assembly to be packaged in a container that is 40, inches by 18, inches by 16, inches. Such a packaged arrangement provides significant cost savings as compared to racks having 72-inch long side support units. For example, this set of dimensions enables three packages to fit on a standard forty inch by forty-eight inch pallet. An exemplary arrangement of the components for packaging is shown in FIGS. 5 and 6.

Figure 7:
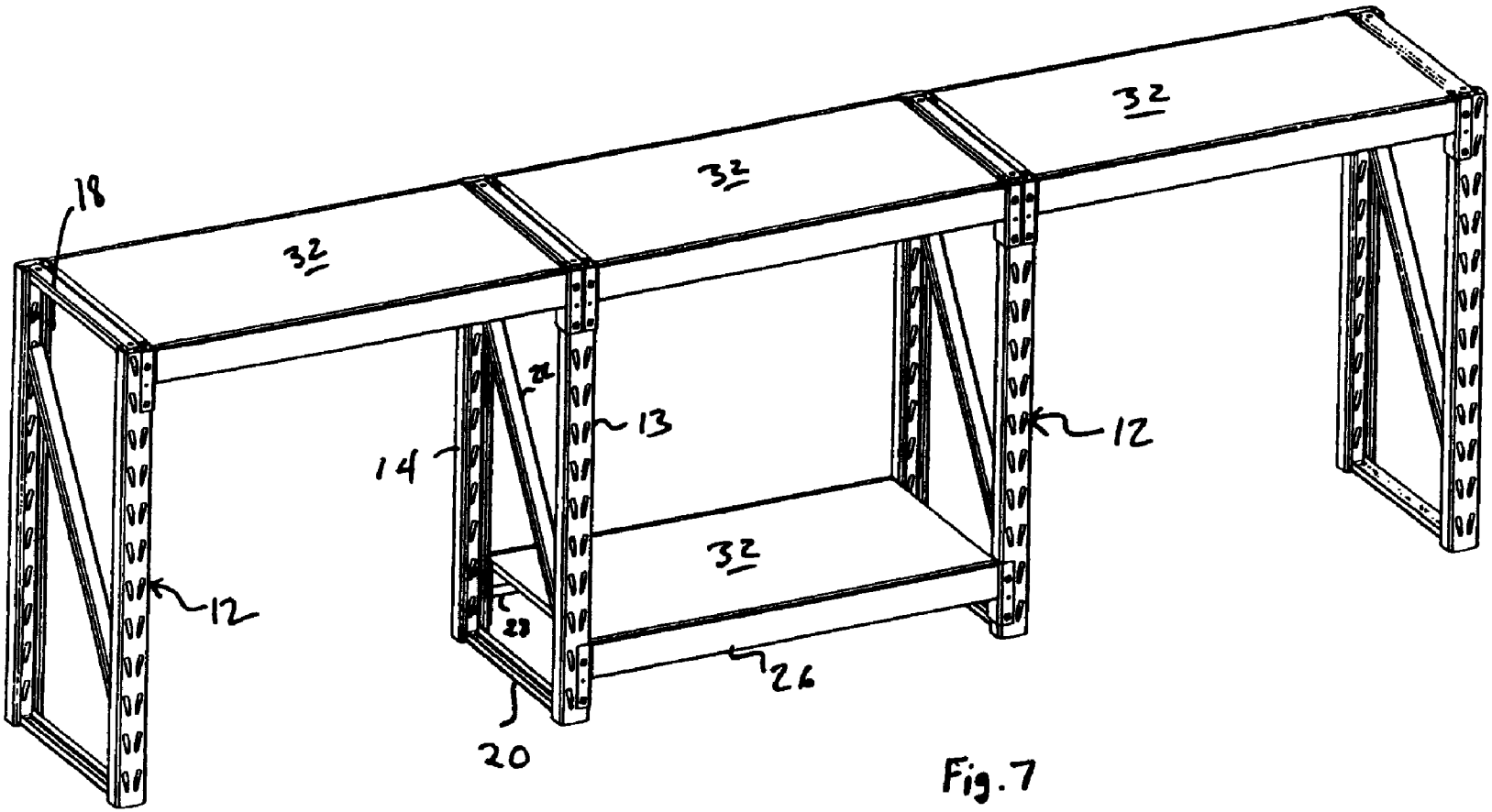
FIG. 7 is a perspective view of a storage rack according to another embodiment of the present invention.

The end support units 12 may also be used as intermediate support units in larger shelf and/or bench assemblies. For example, FIG. 7 shows another exemplary assembly comprising four end-support units 12 used to form an elongated workbench with three shelf panels 32.

Figure 8:
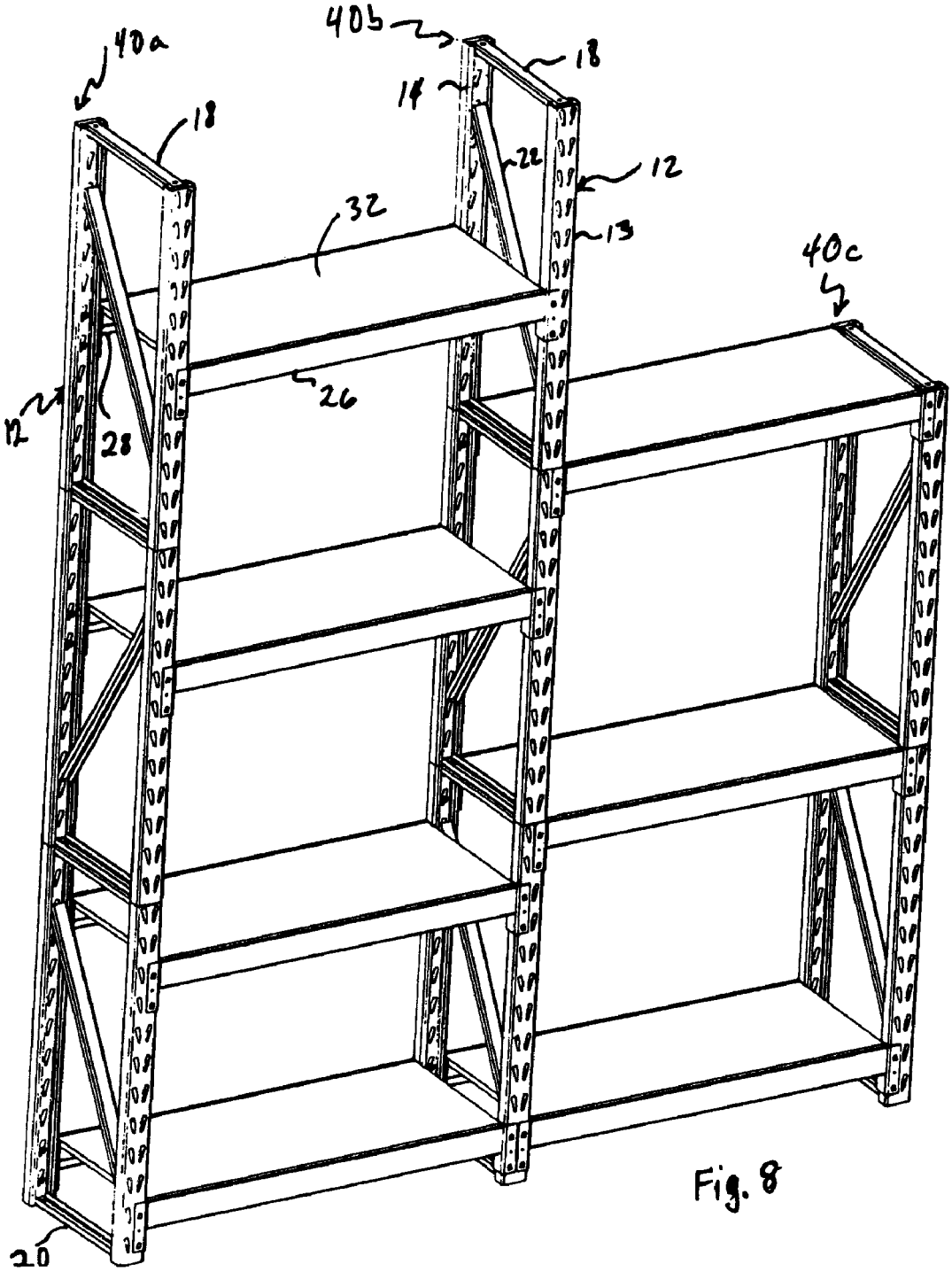
FIG. 8 is a perspective view of a storage rack according to another embodiment of the present invention.
Figure 9:
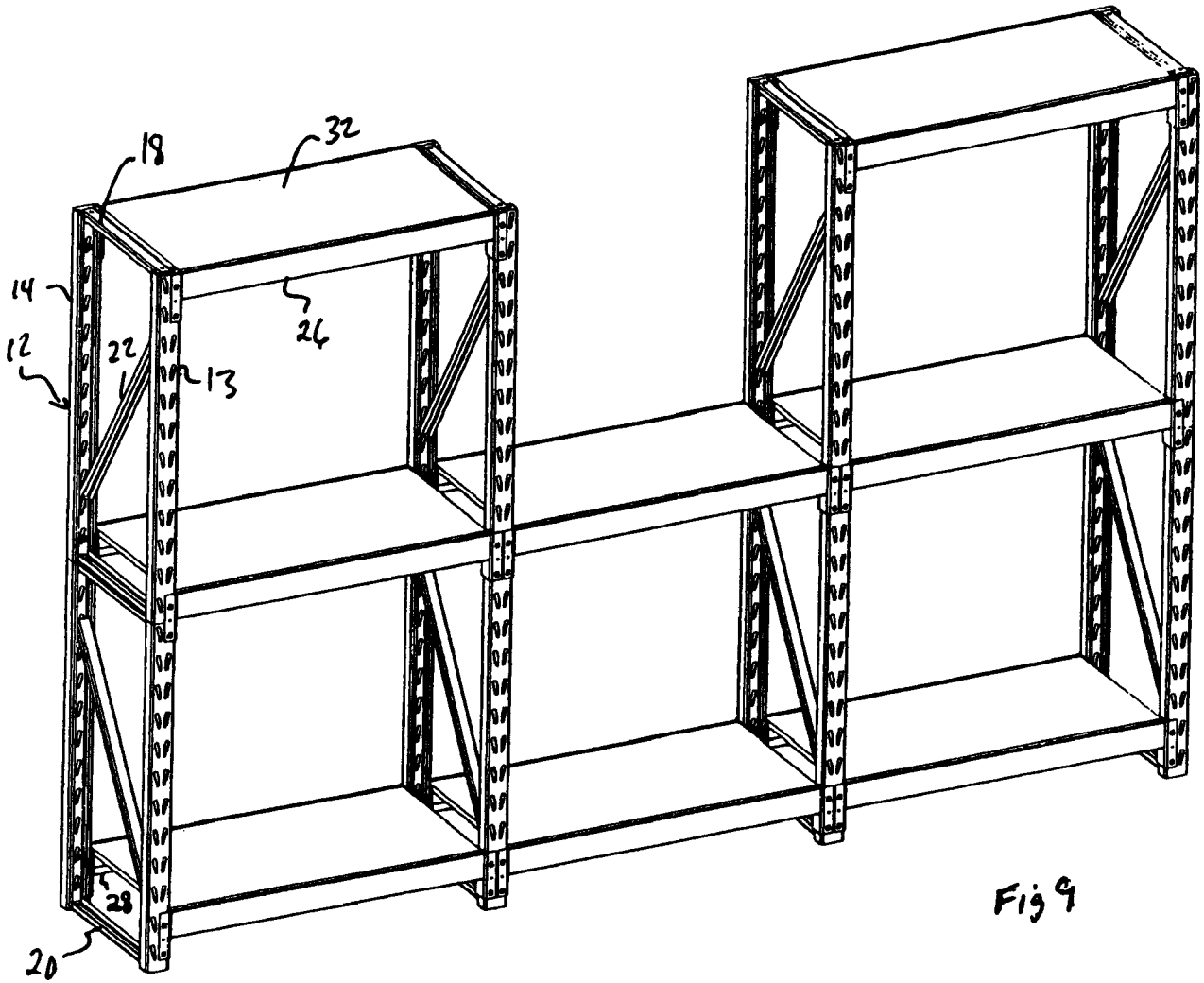
FIG. 9 is a perspective view of a storage rack according to another embodiment of the present invention.
Figure 10:
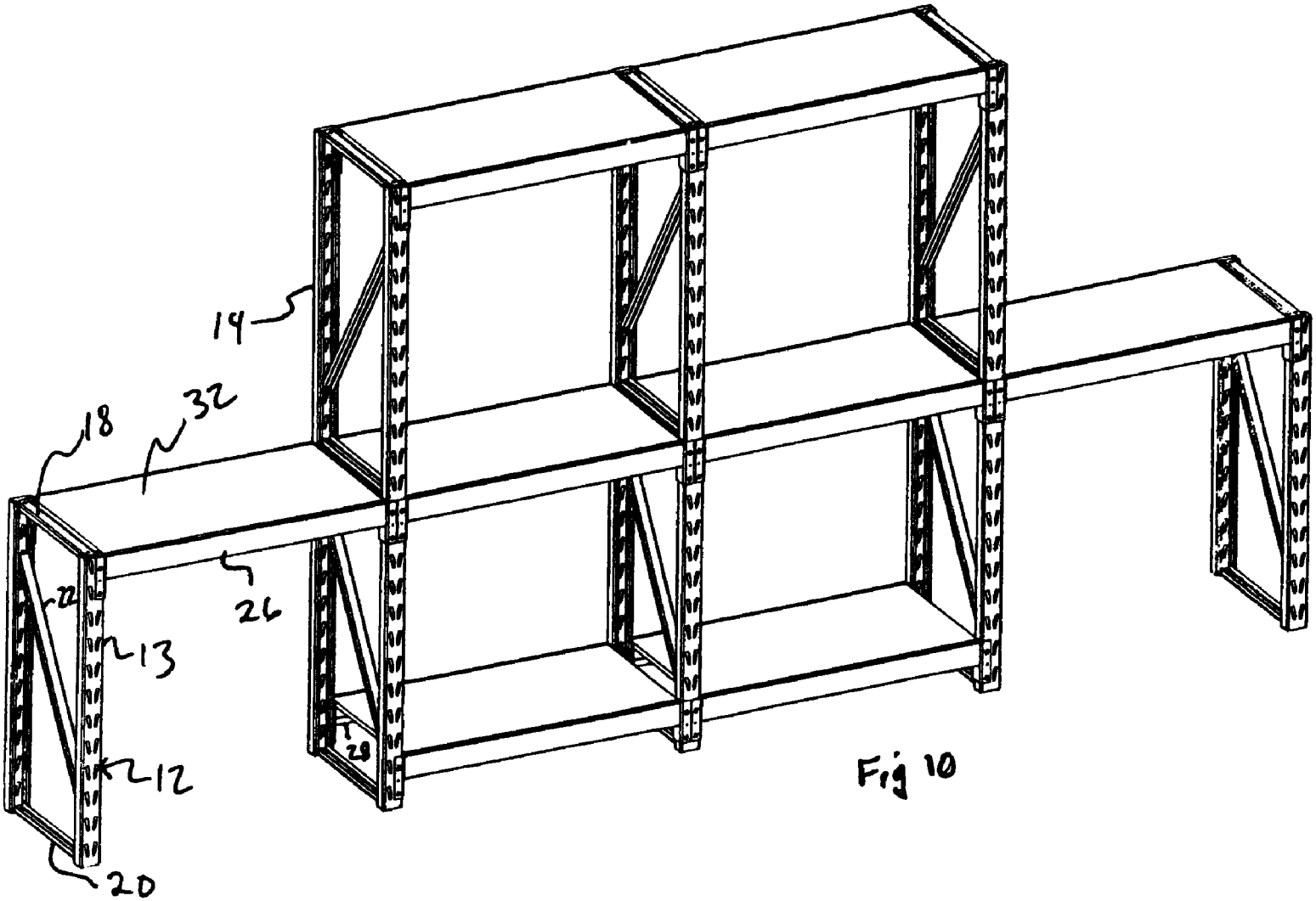
FIG. 10 is a perspective view of a storage rack according to another embodiment of the present invention.

FIG. 8 shows another exemplary assembly including left and middle support assemblies 40*a*,, 40*b*,, which each include three stacked end support units 12. The right support assembly 40*c* includes two stacked end support units 12. Cross-beams 26 and 28 are mounted between the left and middle end-support assemblies 40*a*, and 40*b*, to provide support for four shelf panels 32. Cross-beams 26 and 28 are mounted on and extended between the middle and right support unit assemblies 40*b*, and 40*c*, to provide three shelf panels 32, as shown. FIGS. 9 and 10 show other exemplary assemblies using end support units 12.

The present invention also provides work benches that utilize the benefits of the end support units 12 described above. With the reference to FIG. 11, there is provided a work bench 50 with a pair of opposing right and left end support units 12, and front and rear cross-beams 26 and 28 are mounted on and extend between the left and right front and rear support posts 13 and 14 of the right and left end support units 12 at the top of the support posts 13 and 14. For stabilization, a lower rear cross-beam 28 extends between the rear posts 13 of the right and left end support units 12 at a lower portion of those support posts. A panel 32 is supported at its front and rear edge portions by the upper front and rear cross beams 26 and 28.

A cover 52 is mounted over the upper braces 18 of the right and left end support units 12 to create a generally flat surface at about the same level as the top surfaces of shelf panel 32. In an embodiment of the present invention, the cover 52 has the same cross-sectional configuration as the support posts 13, 14 of the end-support units 12, but without the slots.

A pair of upright supports 54 extend upwardly from the rearward portion of the end support units 12. In an embodiment of the present invention, the uprights supports 54 are made of the same material and have the same cross-sectional configuration of the support posts 13, 14 of the end-support units 12. The upright supports 54 have a generally horizontal flange 56 at their lower ends. The flange 56 extends forwardly and has a hole that aligns with holes in the cover 52 and upper brace 18 of the end support units 12. The upright supports 54 may be secured to the end support units 12 by connectors, such as bolts as previously described. A cross-beam 58 is mounted at its ends to and extends between top ends of the left and right upright supports 54. In the embodiment shown, there is provided a pegboard assembly 60 which extends between the left and right upright supports 54 and between the top of the workbench 50 and the cross-beam 58 at the upper end of the upright supports 54. The pegboard assembly 60 preferably comprises two pegboard panels 62*a*, and 62*b*, connected together by a plastic strip connector 64 having an H-shaped cross-sectional configuration. Such a connector 64 comprises a pair of grooves or recesses for receiving the lower edge of the upper pegboard panel 62*a*, and the upper edge of a lower pegboard panel 62*b*.

Figure 11:
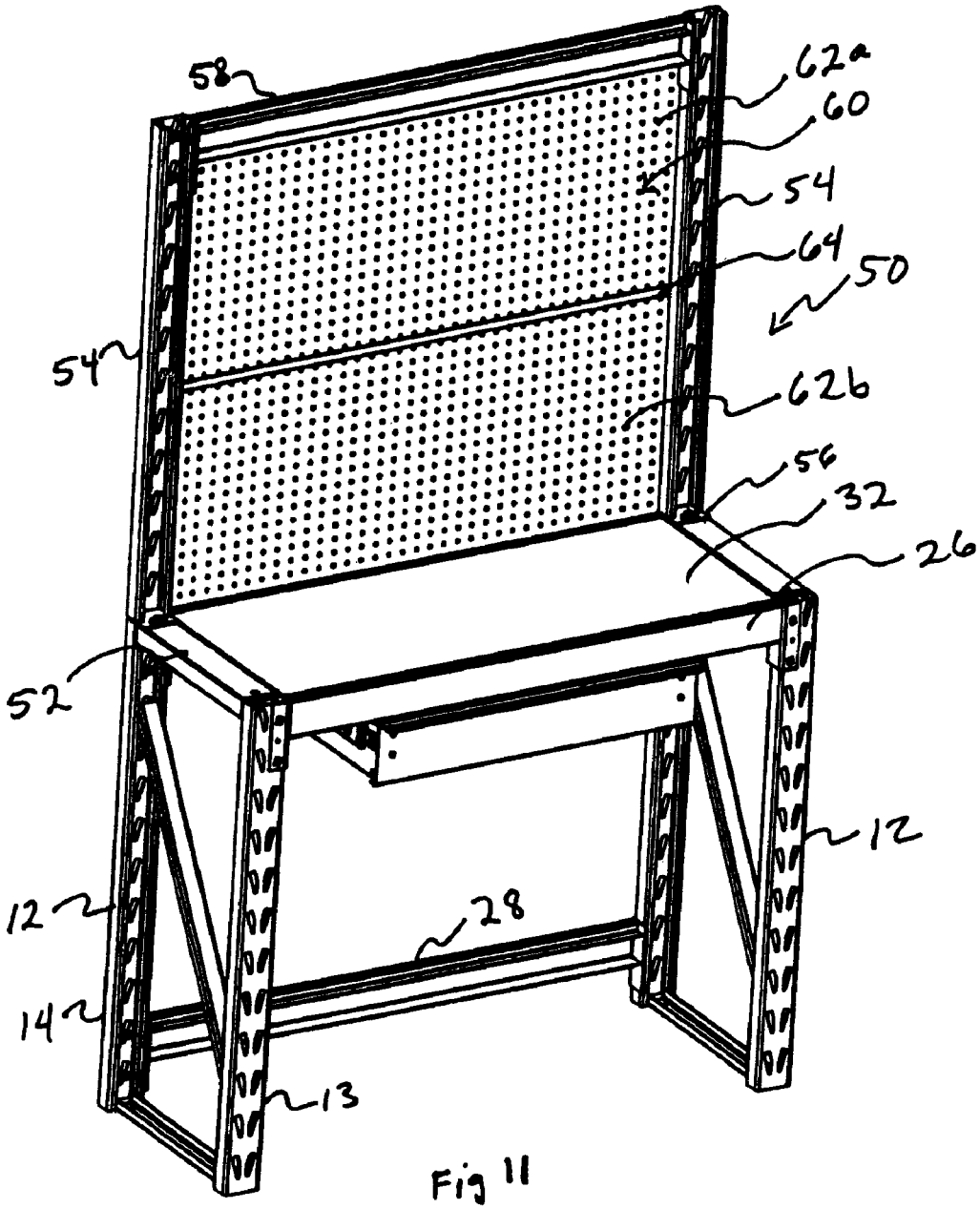
FIG. 11 is a perspective view of a storage rack according to another embodiment of the present invention.

In the exemplary embodiment shown in FIG. 11, the workbench 50 comprises a drawer assembly. Any suitable drawer assembly may be used. Likewise, the workbench 50 could be provided with a lower shelf for storage purposes, if desired.

Figure 12:
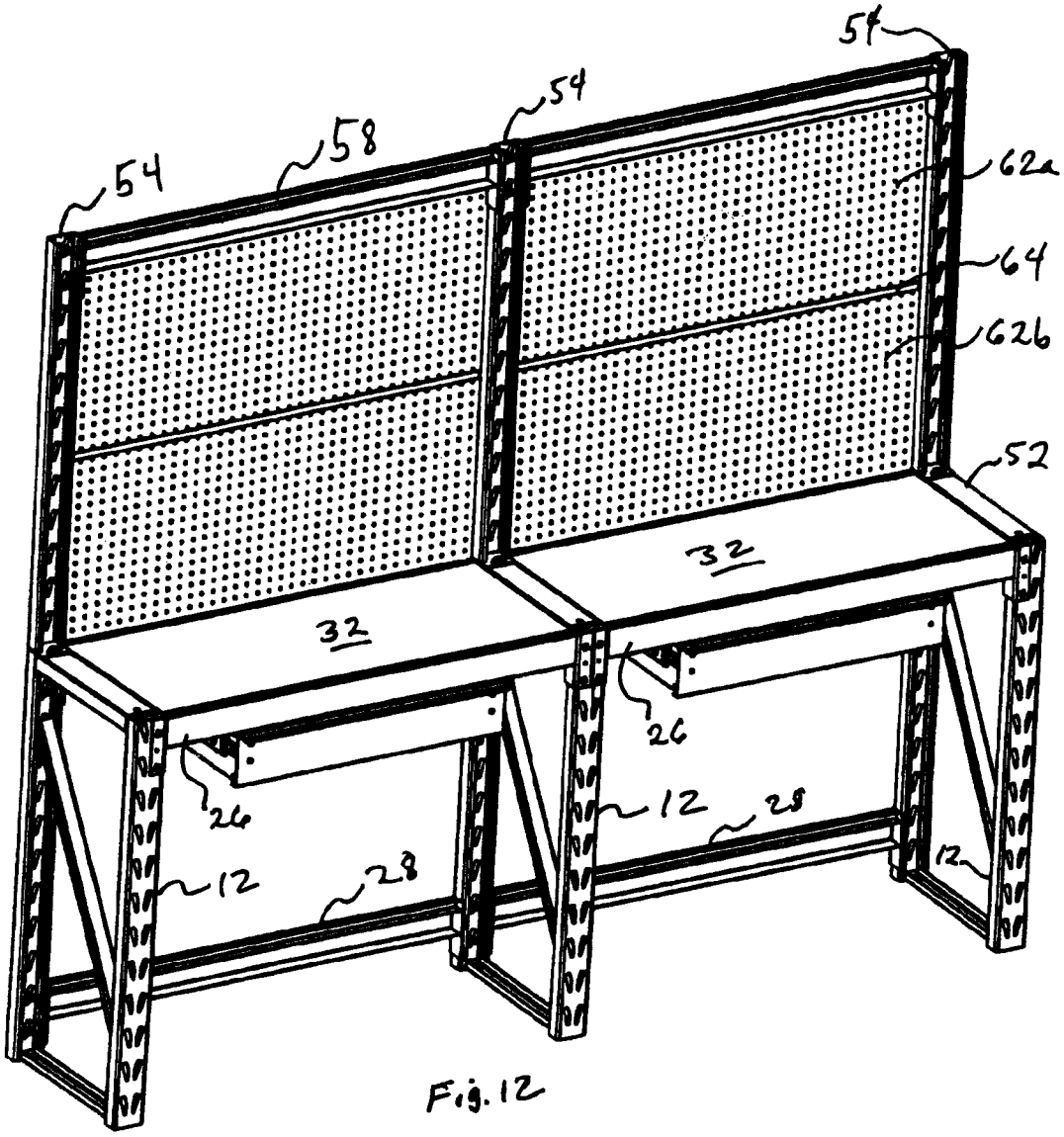
FIG. 12 is a perspective view of a storage rack according to another embodiment of the present invention.

With reference to FIG. 12, there is shown another exemplary workbench constructed according to another embodiment of the present invention. As can be seen, the workbench comprises two workbench assemblies as generally as described in FIG. 11, except that the middle end support unit 12 and upright support 54 provide common support for both workbench units.

While the present invention has been described in connection with certain exemplary embodiments, it is to be understood that the invention is not limited to the disclosed embodiments, but, on the contrary, is intended to cover various modifications and equivalent arrangements thereof.

What is claimed is:

1. A work bench assembly comprising:

right and left end support units for supporting the ends of at least one front and one rear cross beam, each end support unit comprising:

a generally vertical front support post having at least one column of slots along its length for receiving at least one slot engaging member of the front cross beam;

a generally vertical rear support post having at least one column of slots along its length for receiving at least one slot engaging member of the rear cross beam;

a generally horizontal upper brace fixedly attached to and extending from the upper end of the front support post to the upper end of the rear support post;

a cover mounted over the upper brace;

a generally horizontal lower brace fixedly attached to and extending from the lower end of the front support post to the lower end of the rear support post; and at least one diagonal brace fixedly attached to and extending diagonally between the front support post and the rear support post;

an upper front cross beam extending between the upper ends of the front support posts of the right and left end support units;

an upper rear cross beam extending between the upper ends of the rear support posts of the right and left end support units;

a lower rear cross beam extending between a lower portion of the rear support posts of the right and left end support units;

a top panel having front and rear edge portions supported at its front and rear edge portions by the upper front cross beam and upper rear cross beam;

right and left upright supports mounted to and extending upwardly from a rear portion of the right and left end support units;

a cross beam mounted to and extending between the upper ends of the right and left upright supports; and a generally vertical panel extending between at least a portion of the right and left upright supports and below the cross-beam that extends between the upper ends of the upright supports.

2. The workbench assembly as claimed in claim 1, wherein the generally vertical panel comprises pegboard.

3. The workbench assembly as claimed in claim 1, wherein the generally vertical panel comprises upper and lower pegboard panels connected by an elongated strip connector having a generally H-shaped cross-sectional configuration that forms a pair of grooves for receiving the lower end of the upper pegboard panel and the upper edge of the lower pegboard panel

* * * * *

UNITED STATES PATENT AND TRADEMARK OFFICE

CERTIFICATE OF CORRECTION

PATENT NO. : 8,172,098 B2
APPLICATION NO. : 12/436771
DATED : May 8, 2012
INVENTOR(S) : Brian Eustace et al.

It is certified that error appears in the above-identified patent and that said Letters Patent is hereby corrected as shown below:

In the Claims

Column 8, Claim 3, line 11. Delete "panel"

Insert -- panel. --

Signed and Sealed this
Thirteenth Day of November, 2012

David J. Kappos

David J. Kappos
*Director of the United States Patent and Trademark Office*